US005170102A

United States Patent [19]

Sluyterman et al.

[11] Patent Number: 5,170,102

[45] Date of Patent: Dec. 8, 1992

[54] PICTURE DISPLAY DEVICE

[75] Inventors: Albertus A. S. Sluyterman; Marinus L. A. Vrinten; Fransiscus M. P. P. Doomernik, all of Eindhoven, Netherlands

[73] Assignee: U.S. Philips Corporation, New York, N.Y.

[21] Appl. No.: 505,088

[22] Filed: Apr. 4, 1990

[30] Foreign Application Priority Data

Apr. 14, 1989 [NL] Netherlands ..... 8900935

[51] Int. Cl.[5] ..... G09G 1/04; H01J 29/80

[52] U.S. Cl. ..... 315/370; 313/403

[58] Field of Search ..... 315/370, 371, 13.1; 313/437, 408, 403

[56] References Cited

U.S. PATENT DOCUMENTS 3,426,239 2/1969 Kushner ..... 313/403

4,369,396 1/1983 Judd ..... 315/369

FOREIGN PATENT DOCUMENTS 0206518 12/1986 European Pat. Off. ..... 315/364

5150537 11/1980 Japan .

OTHER PUBLICATIONS

Heijnemans et al "The deflecton coils of the 30AX colour picture system", Philips Technical Review 39, No. 6/7 (1980) pp. 154–171.

*Primary Examiner*—Gregory C. Issing

*Attorney, Agent, or Firm*—Robert J. Kraus

[57] ABSTRACT

Picture display device comprising an in-line color display tube having an elongate display screen with a short axis and a long axis, which screen is provided on an inner surface, and a deflection system. The plane in which the undeflected electron beams are located is parallel to the short axis of the display screen. The deflection system comprises a first system of deflection coils for generating a substantially pincushion-shaped deflection field in the direction of the short axis of the display screen and a second system of deflection coils for generating a substantially barrel-shaped deflection field in the direction of the long axis of the display screen. The deflection system has terminals to be connected to a signal generator for scanning the display screen in a raster having a plurality of lines oriented along the short axis of the display screen.

6 Claims, 3 Drawing Sheets

PICTURE DISPLAY DEVICE

BACKGROUND OF THE INVENTION

The invention relates to a picture display device comprising a colour display tube having an elongate display screen with a short axis and a long axis, which screen is provided on an inner surface, a colour selection system arranged in front of the display screen, an electron gun system arranged opposite the display screen for producing co-planar beams, and a deflection system arranged between the electron gun system and the display screen.

Conventional picture display devices of the type described above often have an electron gun system with three guns which are located in one plane. The plane in which the undeflected beams are located is parallel to the long axis of the display screen. The orthogonal deflection fields generated by the deflection system upon energization generally have such a (pincushion and barrel) configuration, viewed in planes transverse to the axis of the display tube, that the display device is self-convergent.

A problem in this type of display device in its current form is the increase in the dimension of the spot in the direction of the long axis of the display screen as the deflection in that direction increases. This problem is not new, but it will become even more manifest in future HDTV systems.

SUMMARY OF THE INVENTION

It is an object of the invention to provide a solution to the problem described above (and where applicable, while maintaining properties of self-convergence).

To this end a picture display device according to the invention is characterized in that the plane in which the undeflected beams are located is parallel to the short axis of the display screen, in that the deflection system has terminals to be connected to a signal generator for scanning the display screen in a raster having a plurality of lines oriented along the short axis of the display screen and in that the deflection system comprises a first system of deflection coils for generating, upon energization, a substantially pincushion-shaped deflection field for deflecting the beams in the direction of the short axis of the display screen and a second system of deflection coils for generating, upon energization, a substantially barrel-shaped deflection field for deflecting the beams in the direction of the long axis of the display screen.

The above-mentioned solution involves a rotation of the plane of the gun, the deflection system as well as the scanning direction associated with the higher of the two beam deflection frequencies through an angle of 90° relative to their conventional orientation. The properties of self-convergence, if any, are not changed.

Rotation of the gun plane and deflection system has the advantage that the unfavourable spot growth per cm is directed along the short axis of the display tube.

In current self-convergent tube-coil systems the horizontal spot growth per cm along the horizontal axis is larger than the vertical spot growth along the vertical axis. This is acceptable in conventional systems, but it is unacceptable in (future) HDTV systems. This means that the use of a rotated gun plane and deflection system with respect to the spot growth will be more and more advantageous as the ratio between the short axis of the display screen and the long axis of the display screen (the "aspect ratio") is smaller and is particularly smaller than 3:4 (certain HDTV systems use, for example a 9:16 tube). However, such a configuration has a north-south raster distortion (the raster distortion at the long sides) which is hard to correct, both electronically and by changing the coil design, as contrasted to the east-west raster distortion (the raster distortion at the short sides) which can easily be corrected both electronically and by changing the coil design. Rotation of the scanning direction associated with the higher beam deflection frequency in the direction of the short axis of the display screen has the advantage that the east-west raster distortion correction can be easily realised from a coil-design point of view and the north-south raster distortion correction can be easily realised by means of an electronic correction circuit. This is utilized in an embodiment of the device according to the invention.

In a device according to the invention a colour selection system with taut wires as well as a system comprising a mask sheet having an arrangement of apertures and a display screen compatible therewith can be used. High-resolution monitor tubes often have mask sheets with an arrangement of circular apertures and a corresponding arrangement of phosphor dots.

A preferred embodiment of the device according to the invention is characterized in that the display screen comprises elongate phosphor areas whose longitudinal axes extend transversely to the short sides of the display screen and in that the colour selection system comprises a mask sheet having an arrangement of elongate apertures whose longitudinal axes extend transversely to the short sides of the display screen.

From a manufacturing-technical point of view it is an advantage, which is all the more important as the display screen and hence the mask is more elongate, that in the above-described preferred embodiment of the device according to the invention the elongate apertures extend in the longitudinal direction of the mask instead of transversely to the longitudinal direction as in conventional shadow mask display tubes.

BRIEF DESCRIPTION OF THE DRAWING

An embodiment of the invention will now be described in greater detail by way of example with reference to the accompanying drawing figures in which.

DESCRIPTION OF THE PREFERRED EMBODIMENT

Figure 1:
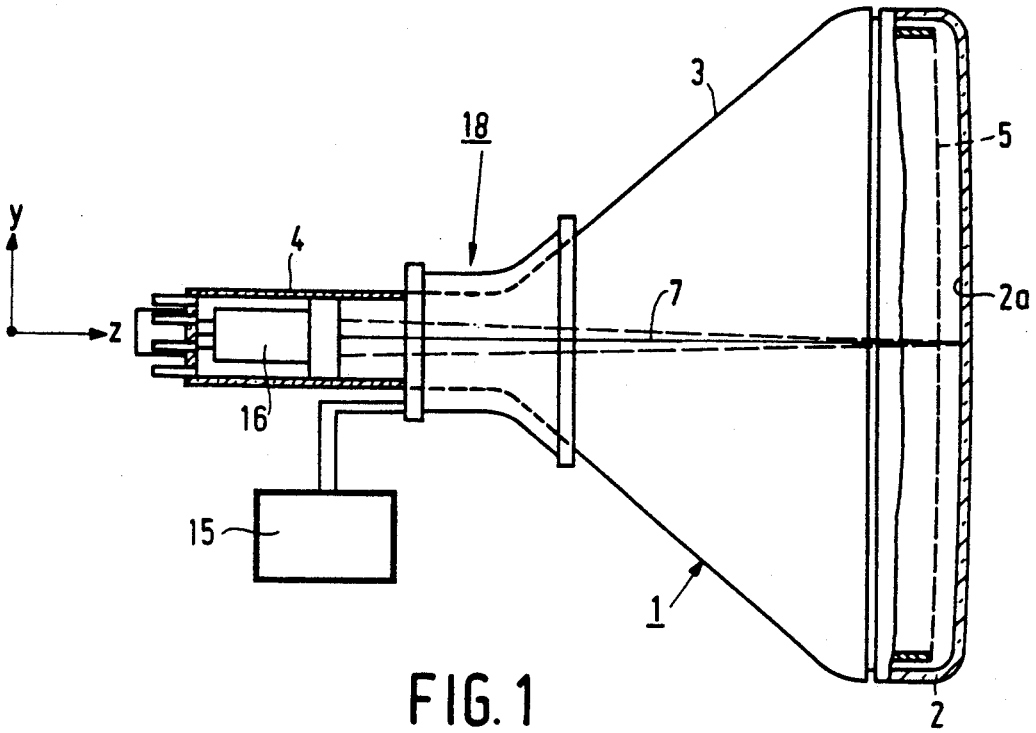
FIG. 1 is a longitudinal section through a colour display tube.
Figure 11:
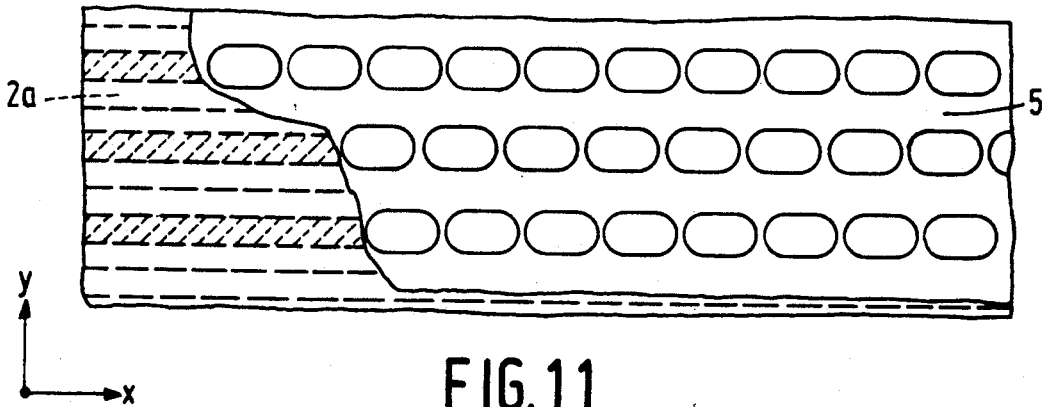
FIG. 11 is a plan view of a shadow mask to be used in a display tube for a display device according to the invention.
Figure 12:
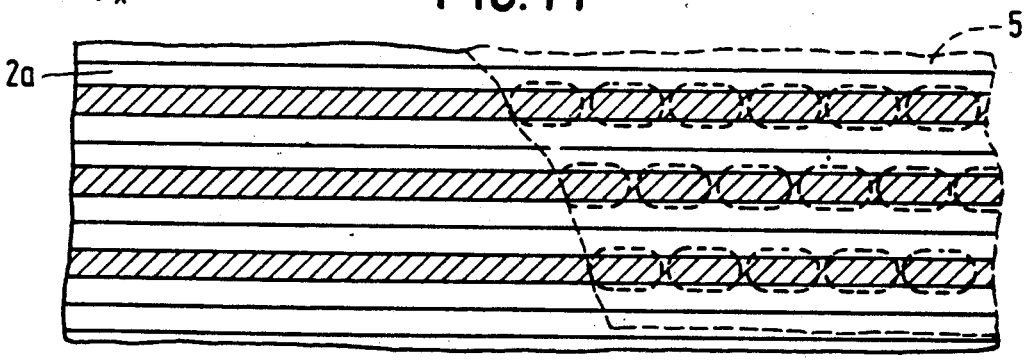
FIG. 12 is a plan view of a display screen to be used in combination with the shadow mask of FIG. 11.

As is shown in FIG. 1, a colour electron beam tube 1 generally has a front portion 2, a funnel portion 3 and a neck portion 4.

The front portion 2 is provided with a fluorescent display screen 2*a* constituted by luminescent materials for the three primary colours red, green and blue, and a shadow mask 5 serving as a colour selection means.

Figure 6:
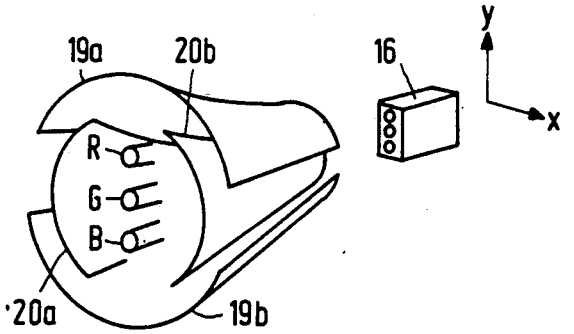
FIG. 6 is a diagrammatic front elevation of an arrangement of a gun system and a deflection coil system according to the invention.
Figure 7:
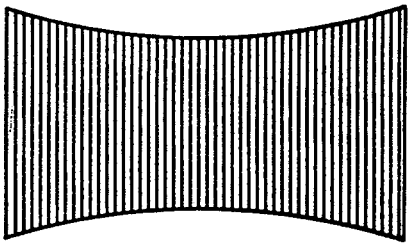
FIG. 7 shows the shape of a raster scanned by the gun-coil arrangement of FIG. 6 in accordance with vertical lines.

The neck portion 4 comprises an electron gun 6 for emitting electron beams 7. The funnel portion 3 connects the front portion 2 and the neck portion 4 in order to define a vacuum space and a deflection system 18 comprising two sets of deflection coils 19*a*, 19*b* and 20*a*, 20*b* (see FIG. 6) is externally mounted in the area of transition between the funnel and neck portions. The deflection system 18 is connected to a signal generator 15 for scanning the display screen 2*a* in accordance with rasters having lines parallel to a display screen axis.

In conventional picture display devices the picture is formed in that lines are substantially horizontally scanned from left to right, for example on the display screen of a picture display tube, while picture information is applied to electrodes of the tube. Thus, picture information is assigned to the elements of the horizontally scanned lines. The successive lines are scanned from top to bottom so that a given number of lines forms a field. A frame comprises two or more fields, or, alternatively, a picture is formed by one field. For example, according to the European television broadcasting standard a frame is composed of 2 interlaced fields of 312½ lines each, the field frequency being 50 Hz and the line frequency being 15,625 Hz. Scanning at the signal source in the studio is identical to scanning upon display. This is ensured by synchronizing signals which are transmitted together with the picture information.

In picture display devices for displaying digitally generated text, so-called monitors, the line frequency may be higher than the frequency prescribed by a television standard. So-called high-definition television (HDTV) systems are also proposed in which the line frequency in the display device is very high, for example 62.5 kHz, which is 4 times as high as the line frequency in the current television standard.

The electron gun 6 arranged in the neck portion 4 is of the in-line type.

Figure 2:
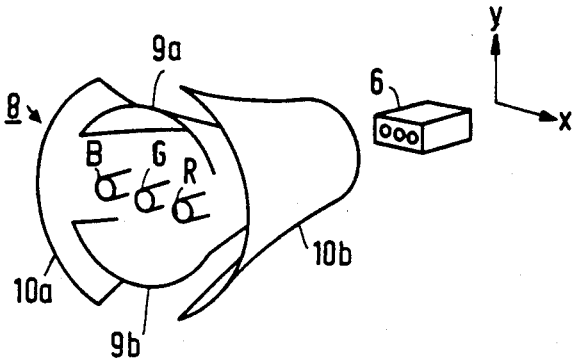
FIG. 2 is a diagrammatic front elevation of an arrangement of a conventional gun system and a deflection coil system.
Figure 3:
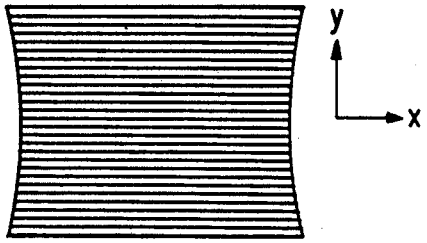
FIG. 3 shows the shape of a raster scanned by the gun-coil arrangement of FIG. 2.

FIG. 2 shows three co-planar electron beams R, G, B which can be generated by an electron gun system 6. A pair 9*a*, 9*b* of deflection coils is used for deflecting the electron beams across a display screen in a direction parallel to the plane of the non-deflected beams, and a pair 10*a*, 10*b* of deflection coils is used for deflection in a direction transverse to said plane. In the case shown both coil pairs are formed as saddle coils. However, they may also be in the form of toroidal coils, particularly the coil pair 10*a*, 10*b*. The electron gun system 6 and the deflection coil system in FIG. 2 are arranged in a conventional manner. In conventional display systems such an arrangement is used to scan a display screen in a raster having a plurality of lines parallel to the long axis of the display screen (FIG. 3).

Figure 8:
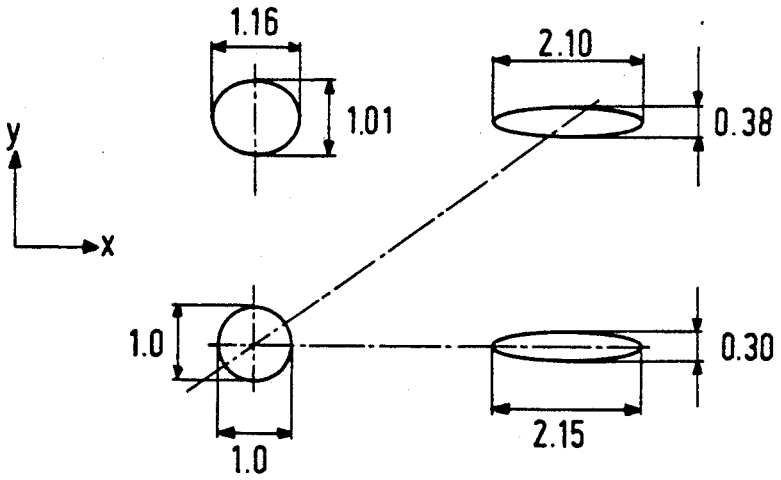
FIG. 8 shows relative spot dimensions in the top right quadrant of the display screen of a conventional display tube having a 3:4 aspect ratio.

When using a self-convergent tube-coil combination a typical (pincushion) raster distortion is produced at the short sides of the raster. This distortion can be easily corrected (by means of an electronic correction circuit). The raster distortion occurring at the long sides of the raster can not easily be corrected by electronic means and is generally corrected by taking measures in the deflection coil system itself, said measures changing the deflection field distribution near the screen-sided end of the deflection unit. As will be explained with reference to FIG. 8, the spot growth is small in the y direction, but considerable in the x direction. FIG. 8 is representative of the spot growth in a conventional self-convergent tube-coil combination with a 3:4 aspect ratio at which the deflection angle is maintained constant across the direction of the diagonal. For smaller aspect ratios the detrimental effect of spot growth in the x direction will even be stronger. This is explained with reference to FIG. 9 which is representative of the spot growth in a display tube having a 9:16 aspect ratio.

Figure 4:
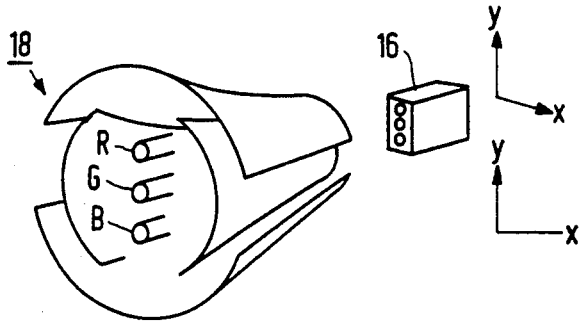
FIG. 4 is a diagrammatic front elevation of an arrangement of a gun system and a deflection coil system according to the invention.
Figure 5:
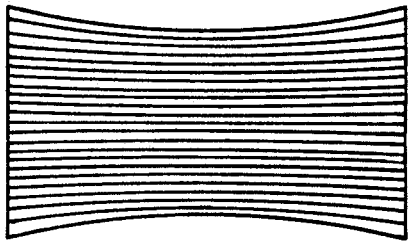
FIG. 5 shows the shape of a raster scanned by the gun-coil arrangement of FIG. 4 in accordance with horizontal lines.
Figure 10:
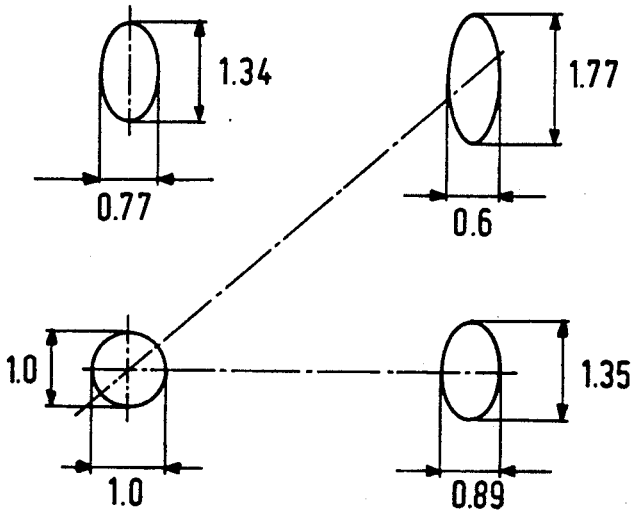
FIG. 10 shows relative spot dimensions in the top right quadrant of the display screen of a display tube of a display system according to the invention.

In the case of a display tube having a (rotated) plane of the undeflected beams of the gun system 16 and a rotated deflection coil system 18 (FIG. 4) the spot growth in the x direction can be reduced considerably because in that case the unfavourable spot growth per unit of distance extends in the direction of the short axis of the display screen. This is illustrated by means of FIG. 10 which is representative of the spot growth in such a display tube having a 9:16 aspect ratio. When scanning a raster having a plurality of lines which are parallel to the long axis of the display screen a (pincushion) raster distortion is produced at the long sides of the raster (FIG. 5) when a self-convergent deflection system is used. Such a raster distortion is difficult to correct, both electronically and by changing the coil-design.

It is an object of the invention to provide a picture display device in which this problem is avoided. To this end the scanning section is adapted to scan the lines in the vertical direction, a plurality of vertical lines constituting a field, the vertical line frequency being many times higher than the horizontal field frequency, the video signal processing section comprising a scan direction transposition circuit for receiving the picture information and for sequentially assigning picture information to elements of the vertically scanned lines.

Due to this measure the scan directions are transposed, the lines being scanned vertically, preferably from top to bottom at the highest scanning frequency, namely the line frequency, and the horizontal scanning, preferably from left to right, at the lowest scanning frequency, namely the field frequency.

By scanning in accordance with a raster having a plurality of lines which are parallel to the short axis of the display screen, the raster distortion at the long sides of the raster can be easily corrected by means of an electronic correction circuit (which modulates the amplitude of the deflection voltages which are applied to the coil system 20*a*, 20*b* (FIG. 6) deflecting in the y direction). In this case the scan at the high frequency thus takes place in the direction of the short axis of the display screen and the scan at the low frequency takes place in the direction of the long axis of the display screen. In order to realise self-convergence, the field configuration of the deflection field generated by coil system 19*a*, 19*b* for deflection in the x direction is barrel-shaped and the field configuration of the deflection field generated by coil system 20*a*, 20*b* (which has the lowest impedance and is preferably arranged closest to the electron beams) for deflection in the y direction is pincushion-shaped.

The shadow mask which is used may be, for example a (hexagonal) apertured mask, but as already noted hereinbefore it is advantageous from a manufacturing-technical (inter alia etching-technical) point of view to use a "slit" mask having slits extending parallel to the long axis of the shadow mask, particularly in display tubes having an aspect ratio of less than 3:4. This shadow mask then co-operates in the display tube with a display screen having elongate phosphor areas which extend parallel to the longitudinal axis of the display screen.

It is to be noted that in cases where images are scanned in a raster with horizontal lines at the pick-up side of the transmission system, a memory is required at the receiver end so as to be able to scan in a raster with vertical lines (so-called transposed scanning). However, this does not prohibit the use of the invention. In monitor tubes for data applications the scan conversion may take place, for example in the software used.

Figure 9:
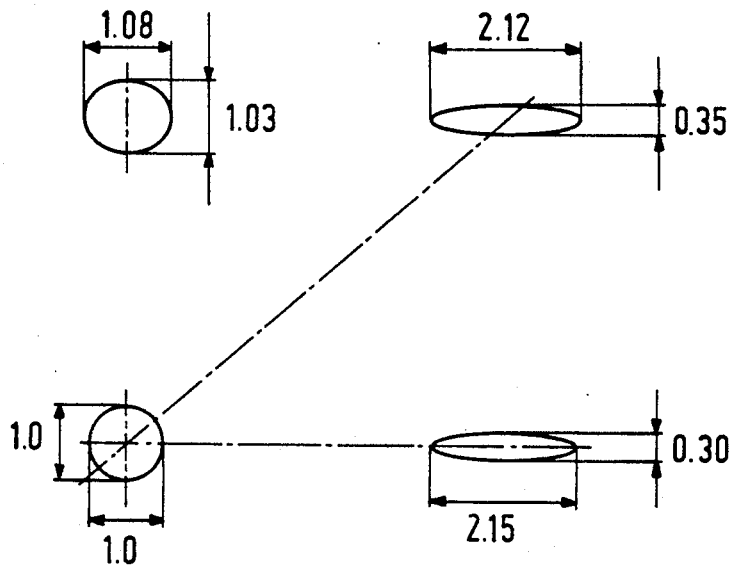
FIG. 9 shows relative spot dimensions in the top right quadrant of the display screen of a convention display tube having a 9:16 aspect ratio.

It is to be noted that in conventional display tubes with a (line) shadow mask Moiré effect problems occur which get bigger as the spot gets smaller. (This is caused by the fact that modulation of the transmission takes place in the vertical direction due to the areas which are present between the slit-shaped apertures). In the conventional display tubes the spot upon deflection in the direction of the slits becomes increasingly narrower (FIG. 9). When using a slit shadow mask rotated through 90° according to the invention, in combination with vertical scanning, the spot upon deflection in the direction of the slits will be much less narrow (FIG. 10) and the problem of the Moiré effect will accordingly be smaller.

We claim:

1. A picture display device comprising a colour display tube having an elongate display screen with a short axis and a long axis, which screen is provided on an inner surface, a colour selection system arranged in front of the display screen, an electron gun system arranged opposite the display screen for producing coplanar beams, and a deflection system arranged between the electron gun system and the display screen, characterized in that the plane in which the undeflected beams are located is parallel to the short axis of the display screen, in that the deflection system has terminals connected to a signal generator for scanning the display screen in a raster having a plurality of lines substantially parallel to the short axis of the display screen and in that the deflection system comprises a first system of deflection coils for generating, upon energization, a substantially pincushion-shaped deflection field for deflecting the beams in the direction of the short axis of the display screen and a second system of deflection coils for generating, upon energization, a substantially barrel-shaped deflection field for deflecting the beams in the direction of the long axis of the display screen.

2. A display device as claimed in claim 1, characterized in that the colour display tube with the deflection system is self-convergent.

3. A display device as claimed in claim 1, characterized in that the display tube has an aspect ratio of less than 3:4.

4. A display device as claimed in claim 1, characterized in that the first system of deflection coils is adapted to be connected to an energizing device comprising an electronic correction circuit for correcting geometrical raster errors at the long sides of the raster formed.

5. A display device as claimed in claim 1, characterized in that the display screen comprises elongate phosphor areas whose longitudinal axes extend transversely to the short sides of the display screen and in that the colour selection system comprises a mask sheet having an arrangement of elongate apertures whose longitudinal axes extend transversely to the short sides of the display screen.

6. A display device as claimed in claim 2, characterized in that the display tube has an aspect ratio of less than 3:4.

* * * * *